US009123997B2

(12) United States Patent
Ieda et al.

(10) Patent No.: US 9,123,997 B2
(45) Date of Patent: Sep. 1, 2015

(54) MULTI-BAND MONOPOLE ANTENNA

(75) Inventors: Kiyokazu Ieda, Kariya (JP); Taku Nakamura, Konan (JP); Eiji Koide, Takahama (JP)

(73) Assignee: AISIN SEIKI KABUSHIKI KAISHA, Aichi-ken (JP)

( * ) Notice: Subject to any disclaimer, the term of this patent is extended or adjusted under 35 U.S.C. 154(b) by 499 days.

(21) Appl. No.: 13/331,551

(22) Filed: Dec. 20, 2011

(65) Prior Publication Data

US 2012/0154253 A1 Jun. 21, 2012

(30) Foreign Application Priority Data

Dec. 21, 2010 (JP) ..... 2010-284693

(51) Int. Cl.

| | |
|---|---|
| ***H01Q 9/30*** | (2006.01) |
| ***H01Q 9/40*** | (2006.01) |
| ***H01Q 1/32*** | (2006.01) |
| ***H01Q 5/357*** | (2015.01) |

(52) U.S. Cl.

CPC ..... *H01Q 9/40* (2013.01); *H01Q 1/3275* (2013.01); *H01Q 5/357* (2015.01)

(58) Field of Classification Search

CPC ..... H01Q 9/30; H01Q 1/085; H01Q 1/3275
USPC ..... 343/900, 715, 713
See application file for complete search history.

(56) References Cited

U.S. PATENT DOCUMENTS

| | | | | |
|---|---|---|---|---|
| 6,633,261 | B2 | 10/2003 | Iwai et al. | |
| 7,825,859 | B2 | 11/2010 | Teshima | |
| 8,035,563 | B2 | 10/2011 | Ishimiya | |
| 2008/0129627 | A1* | 6/2008 | Soler Castany et al. | 343/770 |
| 2009/0213016 | A1* | 8/2009 | Teshima | 343/702 |
| 2011/0068983 | A1* | 3/2011 | Koide et al. | 343/700 MS |

FOREIGN PATENT DOCUMENTS

| | | |
|---|---|---|
| EP | 1 182 727 A2 | 2/2002 |
| EP | 1 962 378 A1 | 8/2008 |

(Continued)

OTHER PUBLICATIONS

European Search Report issued in the European Application No. 11 19 3432 dated Mar. 22, 2012.

(Continued)

*Primary Examiner* — Dameon E Levi
*Assistant Examiner* — Collin Dawkins
(74) *Attorney, Agent, or Firm* — Sughrue Mion, PLLC

(57) ABSTRACT

A multi-band monopole antenna includes a first radiation conductor portion formed with a rod member having a length defined in accordance with a wavelength of a first frequency included in a predetermined first frequency band among plural frequency bands, and a second radiation conductor portion integrally connected with the first radiation conductor portion and formed with a planar member in which a direct distance from a feeding portion to a farthest point which is the farthest position from the feeding portion is defined in accordance with a wavelength of a second frequency included in a second frequency band which differs from the first frequency band among the plural frequency bands. The feeding portion is provided at a position based on the length defined in accordance with the wavelength of the first frequency relative to a position of a tip end of the first radiation conductor portion.

8 Claims, 6 Drawing Sheets

(56) References Cited

FOREIGN PATENT DOCUMENTS

| | | | |
|---|---|---|---|
| EP | 2 146 392 | A2 | 1/2010 |
| JP | 2004-193875 | A | 7/2004 |
| JP | 2005-191803 | A | 7/2005 |
| JP | 2008-66779 | A | 3/2008 |
| JP | 2008-306436 | A | 12/2008 |
| JP | 2009-017116 | A | 1/2009 |
| JP | 2011-091780 | A | 5/2011 |

OTHER PUBLICATIONS

Communication from the Japanese Patent Office issued Jul. 10, 2014 in a counterpart Japanese Patent Application No. 2010-284693.

Japanese Office Action issued Dec. 18, 2014 in Japanese Patent Application No. 2010-284693.

* cited by examiner

MULTI-BAND MONOPOLE ANTENNA

CROSS REFERENCE TO RELATED APPLICATIONS

This application is based on and claims priority under 35 U.S.C. §119 to Japanese Patent Application 2010-284693, filed on Dec. 21, 2010, the entire content of which is incorporated herein by reference.

TECHNICAL FIELD

This disclosure generally relates to a multi-band monopole antenna.

BACKGROUND DISCUSSION

An antenna sending and receiving signals at multiple frequency bands is known. For example, a known multi-frequency antenna device sending and receiving signals at multiple frequency bands is disclosed in JP2008-306436A (i.e., hereinafter referred to as Patent reference 1). The known multi-frequency antenna device disclosed in the Patent reference 1 is provided with multiple numbers of monopole antennas. The monopole antennas are provided on one surface of a circuit board via a strip conductor, and a ground plate is provided on the other surface of the circuit board. The strip conductor, the circuit board, and the ground plate forms a micro-strip line, and each of the monopole antennas are fed with electricity via the micro-strip line.

According to the known multi-frequency antenna device disclosed in the Patent reference 1, the strip conductor is formed in a meander line so that an entire length of the strip conductor is assumed to be approximately a half length (½) of the wavelength of resonant frequency. An impedance converter is provided between the strip conductor and a coaxial cable connected to the strip conductor to match the impedance. Settings for the impedance converter are complex, and design and development of the impedance converter requires time and effort. Further, because forming the strip conductor in meander line geometry increases the dimensional area of the strip conductor, the dimension of the antenna device is increased.

A need thus exists for a multi-band monopole antenna which is not susceptible to the drawback mentioned above.

SUMMARY

In light of the foregoing, the disclosure provides a multi-band monopole antenna, which includes a first radiation conductor portion formed with a rod member having a length defined in accordance with a wavelength of a first frequency included in a predetermined first frequency band among plural frequency bands, and a second radiation conductor portion integrally connected with the first radiation conductor portion and formed with a planar member in which a direct distance from a feeding portion to a farthest point which is the farthest position from the feeding portion is defined in accordance with a wavelength of a second frequency included in a second frequency band which differs from the first frequency band among the plural frequency bands. The feeding portion is provided at a position based on the length defined in accordance with the wavelength of the first frequency relative to a position of a tip end of the first radiation conductor portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
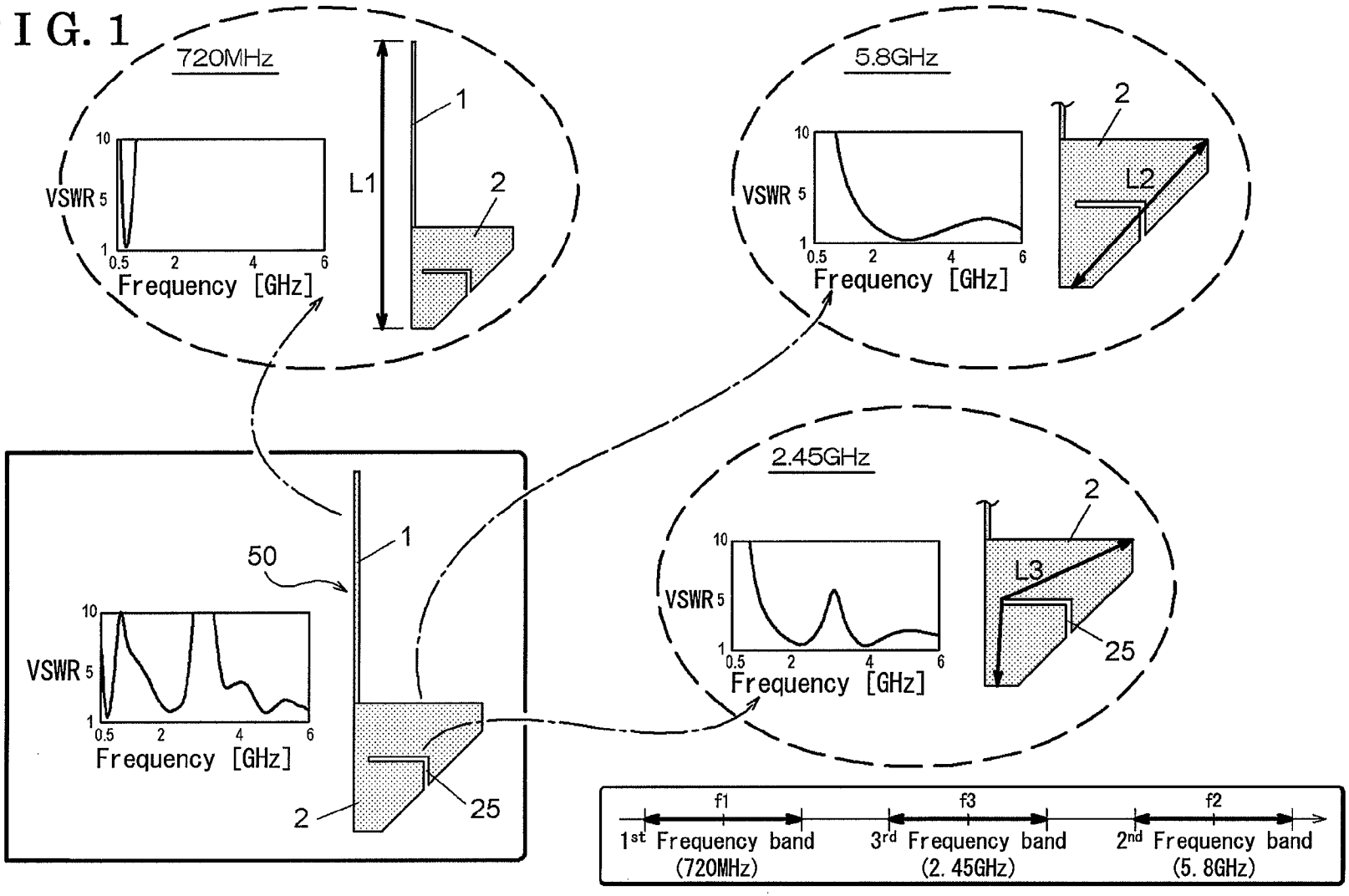
FIG. 1 is a schematic view of a concept for a multi-band monopole antenna according to a first embodiment disclosed here.

Embodiments of a multi-band monopole antenna will be explained with reference to illustrations of drawing figures as follows. In those circumstances, the drawing figures are illustrated without considering dimensions. FIG. 1 schematically shows a concept of a multi-band monopole antenna 50. The multi-band monopole antenna 50 is configured to send and receive signals of multiple band frequencies. For example, according to the embodiments, the multi-band monopole antenna 50 operates at frequencies of 720 MHz band, 2.45 GHz band, and 5.8 GHz band (for example, operates at frequencies centered around 720 MHz, 2.45 GHz, and 5.8 GHz).

As shown in FIG. 1, the multi-band monopole antenna 50 includes a first radiation conductor portion 1 and a second radiation conductor portion 2. As shown in a bottom-left view in FIG. 1, the first radiation conductor portion 1 and the second radiation conductor portion 2 define an electrical length L1. As shown in a top-right view and a bottom-right view in FIG. 1, the second radiation conductor portion 2 defines an electrical length L2 and an electrical length L3. An opening portion 25 formed with a predetermined width is formed on the second radiation conductor portion 2. The electrical length L2 is defined across the opening portion 25. The electrical length L3 is defined detouring the opening portion 25.

The electrical length L1 is set in accordance with the frequency included in the 720 MHz band. The electrical length L2 is set in accordance with the frequency included in 5.8 GHz band. The electrical length L3 is set in accordance with the frequency included in 2.45 GHz band. Because the multi-band monopole antenna 50 includes the electrical lengths L1, L2, L3, according to the embodiments, the multi-band monopole antenna 50 can send and receive the signals at triple frequency bands.

Figure 2:
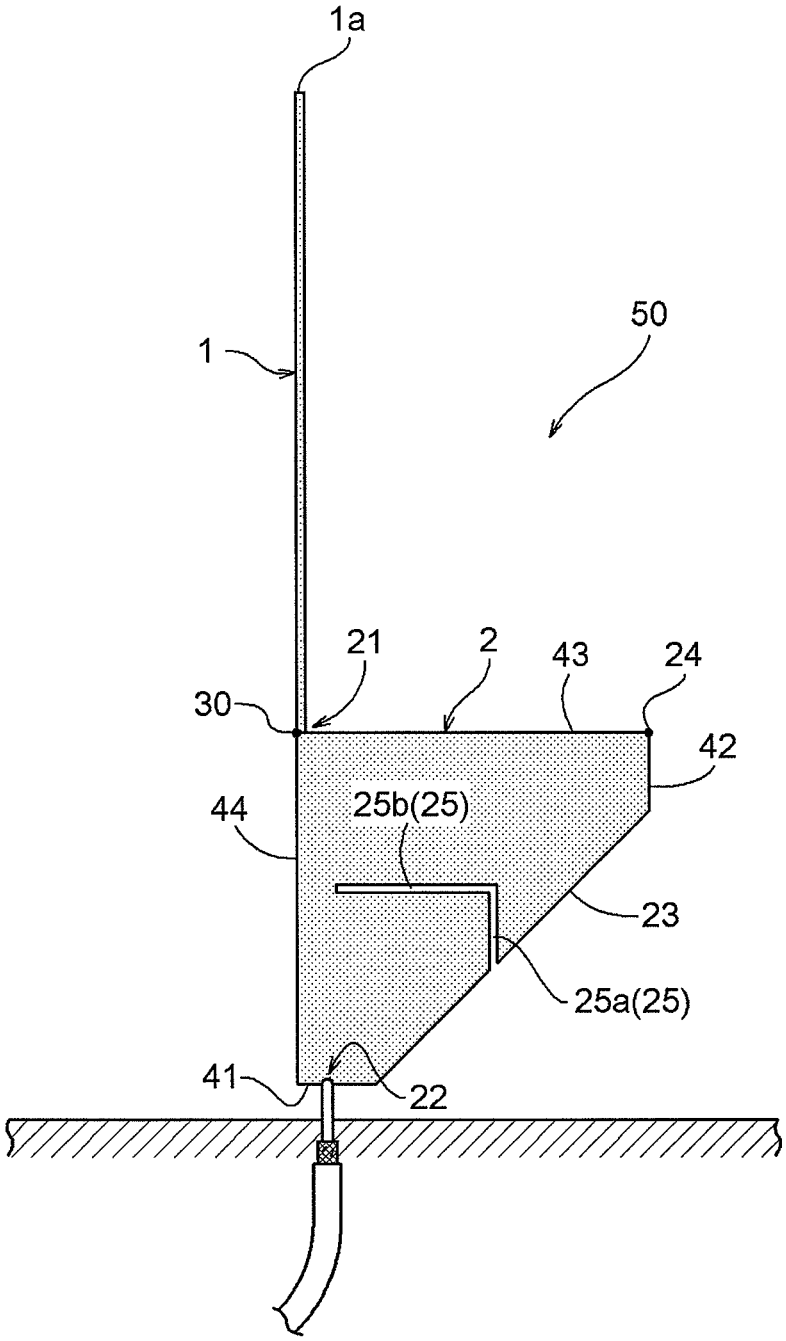
FIG. 2 is a schematic view of the multi-band monopole antenna according to the first embodiment disclosed here.

FIG. 2 schematically shows the construction of the multi-band monopole antenna 50. As shown in FIG. 2, the first radiation conductor portion 1 includes a rod-shaped member having a length determined in accordance with a wavelength of a first frequency included in a predetermined first frequency band among the multiple frequency bands. For example, the multiple frequency bands correspond to the triple frequency bands according to the embodiments. The predetermined first frequency band corresponds to the lowest frequency band among triple frequency bands. Thus, according to the embodiments, the 720 MHz band serves as the first frequency band. For example, the 720 MHz band is determined in a range including approximately 10% lower or higher frequencies centered around the 720 MHz (i.e., 720 MHz±10%). For an explanatory purpose, a first frequency f1 is referred to as 720 MHz.

Further, the first radiation conductor portion 1 includes the rod-shaped member whose length is defined in accordance with a wavelength λ1 of the first frequency f1. That is, the first radiation conductor portion 1 is constructed so that the length from an end portion 1*a* of the rod-shaped member of the first radiation conductor portion 1 to a feed point (i.e., serving as a feeding portion) 22 provided at the second radiation conductor portion 2 is defined to be the electrical length L1 in accordance with the wavelength λ1 of the first frequency f1. According to the embodiment, for example, the electrical length L1 is set to be λ¼. Thus, the length of the first radiation conductor portion 1 from the end portion 1*a* of the rod-shaped member to the feed point 22 provided at the second radiation conductor portion 2 is determined to be approximately 105 mm. The first radiation conductor portion 1 serves as an antenna element for the multi-band monopole antenna.

The second radiation conductor portion 2 serving as the antenna element for the multi-band monopole antenna together with the first radiation conductor portion 1 is formed in a planar member. According to the embodiment, the second radiation conductor portion 2 is structured with the planar member having a pentagonal cross-section (five-sided cross-section) which is formed by removing (e.g., cutting) a right triangle including one right angle portion of a square shaped radiation conductor member. The second radiation conductor portion 2 includes a connecting portion 21, the feed point 22, and a cut oblique side 23. At the connecting portion 21, the second radiation conductor portion 2 and the first radiation conductor portion 1 are connected. As explained above, the first radiation conductor portion 1 is formed in a rod shape. The connecting portion 21 of the second radiation conductor portion 2 is electrically connected to an end of the rod-shaped member. Being electrically connected is defined as a state where the first radiation conductor portion 1 and the second radiation conductor portion 2 are conductive in a state where the first radiation conductor portion 1 and the second radiation conductor portion 2 are connected, and ideally, the first radiation conductor portion 1 and the second radiation conductor portion 2 are connected at an impedance of zero ohm (0Ω) (i.e., having zero ohm (0Ω) of impedance). According to the embodiment, the connecting portion 21 is provided at a corner portion 30, provided at the second radiation conductor portion 2, positioned opposite to the cut oblique side 23.

The feed point 22 corresponds to a terminal which energizes the first radiation conductor portion 1 and the second radiation conductor portion 2. Because the multi-band monopole antenna 50 is a monopole antenna, a ground conductor serving as a pair with the antenna element (i.e., each of the first radiation conductor portion 1 and the second radiation conductor portion 2) of the multi-band monopole antenna 50 is not provided. A metal conductor provided at the multi-band monopole antenna 50 serves as the ground conductor. The feed point 22 is provided at an outer rim portion, being away from the connecting portion 21, of the planar member which structures the second radiation conductor portion 2. According to the embodiment, the feed point 22 is provided at the position which is set in accordance with the wavelength λ1 of the first frequency f1 relative to the position of the end portion 1*a* of the first radiation conductor portion 1. That is, the feed point 22 is provided at the position relative to the first radiation conductor portion 1 so that the length from the end portion 1*a* of the rod-shaped member of the first radiation conductor portion 1 to the feeding point 22 is assumed to be approximately 105 mm.

The cut oblique side 23 is formed by removing a part of an outer rim portion of the planar member which ranges from the feed point 22 to a farthest point 24. In those circumstances, the farthest point 24 corresponds to the position which is farthest from the feed point 22 among the planar member which structures the second radiation conductor portion 2. According to the embodiment, the second radiation conductor portion 2 is formed in the pentagonal (five-sided) shape. Thus, the farthest point 24 is provided at the outer rim portion of the pentagonal (five-sided) cross-section. Thus, the outer rim portion of the planar member ranging from the feed point 22 to the farthest point 24 corresponds to the outer rim portion of the pentagonal (five-sided) cross-section between the feed point 22 and the farthest point 24. The cut oblique side 23 is formed by removing a part of the outer rim portion, and the outer rim portion exposed by being cut corresponds to an oblique portion exposed by removing a right triangle including a right angle portion from the rectangular configuration in cross-section. Thus, the cut oblique side 23 is defined.

According to the embodiment, the connecting portion 21 of the second radiation conductor portion 2 which is integrally connected to the first radiation conductor portion 1 is provided at the corner portion 30 which is opposite to the cut oblique side 23. An apex which is not adjacent to two side portions 41, 42 which adjacent to the cut oblique side 23 corresponds to the corner portion 30 which is opposite to the cut oblique side 23 among five apexes of the pentagonal (five-sided) configuration.

The feed point 22 is provided at one of the sides among two sides which are adjacent to the cut oblique side 23. According to the embodiment, the two sides correspond to the side portions 41, 42, and one of the side portions to which the feed point 22 is provided corresponds to the side portion 41.

The second radiation conductor portion 2 is structured with the planar member in which a direct distance from the feed point 22 to the farthest point 24 is set, or defined in accordance with the wavelength of the second frequency included in the second frequency band which differs from the first frequency band. Among the plural frequency bands, according to the embodiment, a 5.8 GHz band serves as the second frequency band as shown in FIG. 1. For example, the 5.8 GHz band is determined in a range including approximately 10% lower or higher frequencies centered around the 5.8 GHz (i.e., 5.8 GHz±10%). For an explanatory purpose, a second frequency f2 is referred to as 5.8 GHz.

Further, the direct distance from the feed point 22 to the farthest point 24 corresponds to the electrical length L2 serving as an antenna element for the second radiation conductor portion 2. With the construction of the embodiment, the first radiation conductor portion 1 and the second radiation conductor portion 2 structure a monopole antenna. Alternatively, according to the construction of the second radiation conductor portion 2, a monopole antenna may function only with the second radiation conductor portion 2. Particularly, according to the embodiment, the electrical length L2 is set as λ¾. In those circumstances, the electrical length L2 is set to be approximately 30 mm.

According to the embodiment, the opening portion 25 is formed on the second radiation conductor portion 2. The opening portion 25 is formed crossing a line connecting the feed point 22 and the farthest point 24. The line connecting the feed point 22 and the farthest point 24 corresponds to a line along the electrical length L2 of the second radiation conductor portion 2. According to the embodiment, the opening portion 25 includes an extending portion 25*a* and a perpendicular portion 25*b*. The extending portion 25*a* is formed extending from the cut oblique side 23. The perpendicular portion 25*b* is formed at an end portion (i.e., an end portion which is not adjacent to the cut oblique side 23) of the extending portion 25*a* to be arranged perpendicularly to the extending portion 25*a* towards a side 44. The extending portion 25*a* and the perpendicular portion 25*b* are formed to have a constant width. Thus, the opening portion 25 is formed in a slit. A state in which the opening portion 25 is formed crossing the line connecting the feed point 22 and the farthest point 24 corresponds to the state in which the opening portion 25 and the line connecting the feed point 22 and the farthest point 24 cross each other. According to the embodiment, the perpendicular portion 25 and the line connecting the feed point 22 and the farthest point 24 are configured to cross one another.

When the frequency of the signal at the antenna is low, the signal propagates the conductor portion of the antenna. On the other hand, when the frequency of the signal at the antenna is higher, the signal propagates across (propagates over, jumps across) a slight gap (the opening portion). The form of the propagation is determined depending on the frequency of the signal and the width of the opening portion (the gap). According to the embodiment, the width of the opening portion 25 is formed to have a width which the signal of the second frequency band can propagate across, however the signal of a third frequency band cannot propagate across.

Accordingly, the second radiation conductor portion 2 is structured to have an electrical length which is in accordance with a wavelength of a third frequency included in the third frequency band which is higher than the first frequency band and lower than the second frequency band among the plural frequency bands. Here, the plural frequency bands correspond to triple frequency bands in the embodiment. According to the embodiment, the 2.45 GHz band corresponds to the third frequency band. For example, the 2.45 GHz band is determined in a range including approximately 10% lower or higher frequencies centered around 2.45 GHz (i.e., 2.45 GHz±10%). For an explanatory purpose, a third frequency f3 is referred to as 2.45 GHz.

The electrical length L3 in accordance with the wavelength λ3 of the third frequency f3 is defined (see FIG. 1). Particularly, the electrical length L3 is set to be λ¾ according to the embodiment. In those circumstances, the electrical length L3 corresponds to the length from the feed point 22 to the farthest point 24 which is the farthest position from the feed point 22 by way of an end portion of the opening portion 25 which is not adjacent to the cut oblique side 23 in the radiation conductor portion 2. For example, the electrical length L3 is set approximately at 30 mm.

Figure 3A:
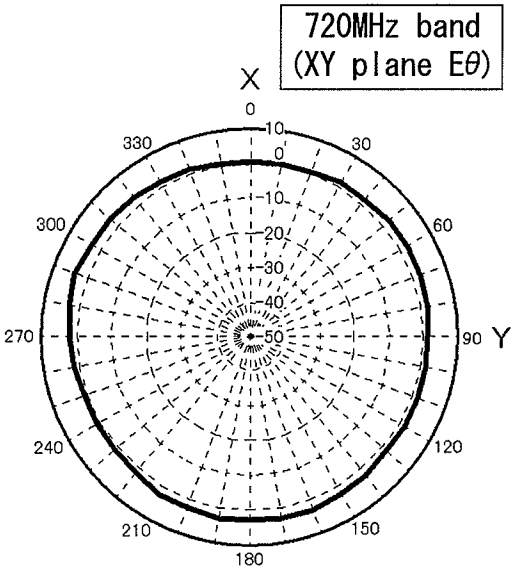
FIG. 3A is a view showing a radiation pattern at 720 MHz band.
Figure 3B:
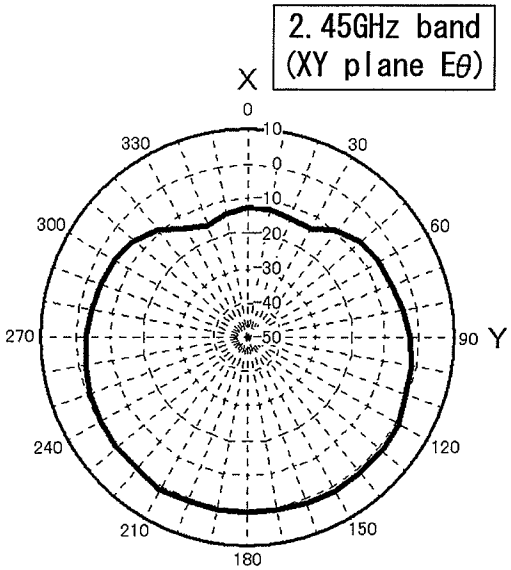
FIG. 3B is a view showing a radiation pattern at 2.45 GHz band.
Figure 3C:
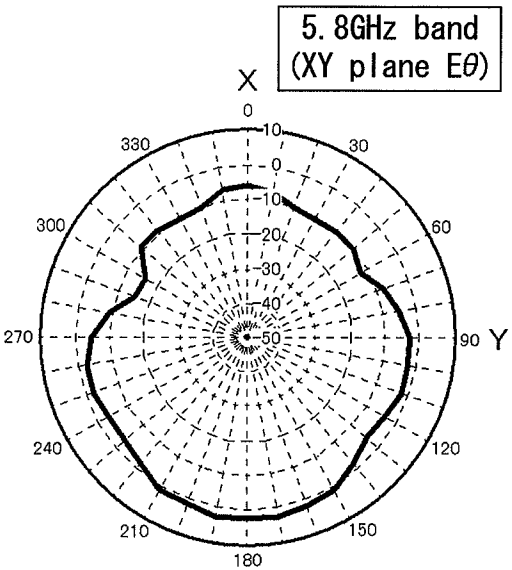
FIG. 3C is a view showing a radiation pattern at 5.8 GHz band.
Figure 3D:
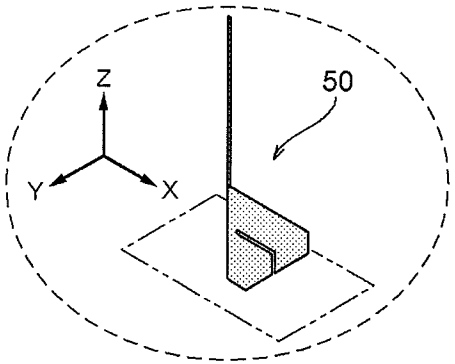
FIG. 3D is a view indicating directions of the multi-band monopole antenna.

FIG. 3A-3D show a directivity of the multi-band monopole antenna 50 according to the embodiment. FIG. 3A shows a directivity at the 720 MHz, FIG. 3B shows a directivity at the 2.45 GHz, and FIG. 3C shows a directivity at the 5.8 GHz. Directions of each directivity are shown in FIG. 3D. As shown in FIGS. 3A to 3C, in a case where an X-Y plane is defined as a horizontal plane, although patterns indicating the directivity of the multi-band monopole antenna 50 are slightly distorted, the amount of the distortion is relatively small compared to the entire configuration of the patterns, and there is little bias in the directivities in the horizontal direction. Thus, the multi-band monopole antenna 50 is applicable to the broadband (wideband).

Figure 4:
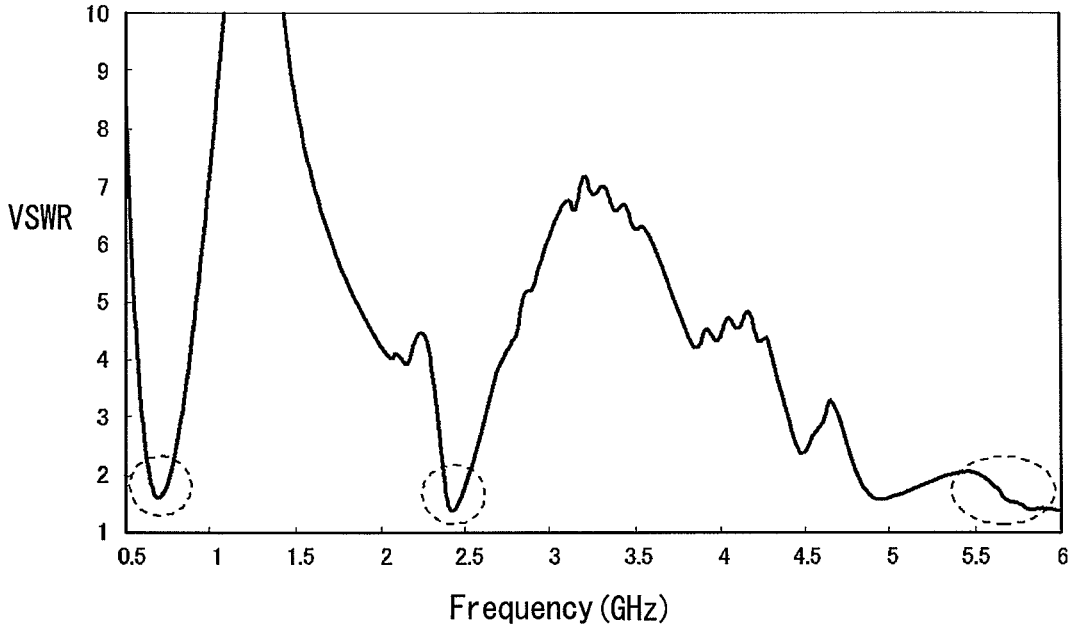
FIG. 4 is a graph showing Voltage Standing Wave Ratio characteristics of the multi-band monopole antenna according to the first embodiment disclosed here.

FIG. 4 shows actually measured data of frequency-voltage standing wave ratio (VSWR) characteristics at the multi-band monopole antenna 50. As shown in FIG. 4, the VSWR is equal to or less than 2.0 at frequencies of 720 MHz, 2.45 GHz, and 5.8 GHz (at frequencies centered around 720 MHz, 2.45 GHz, and 5.8 GHz) which are the frequencies desired for the antenna function in the actually measured data. That is, the multi-band monopole antenna 50 is applicable at the desired frequency bands. In those circumstances, according to the actually measured data, shown in FIG. 4, a frequency (frequency band) equal to or greater than the 5 GHz shows wideband characteristics. Thus, the multi-band monopole antenna 50 according to the embodiment is appropriately applicable to plural frequency bands.

Figure 5:
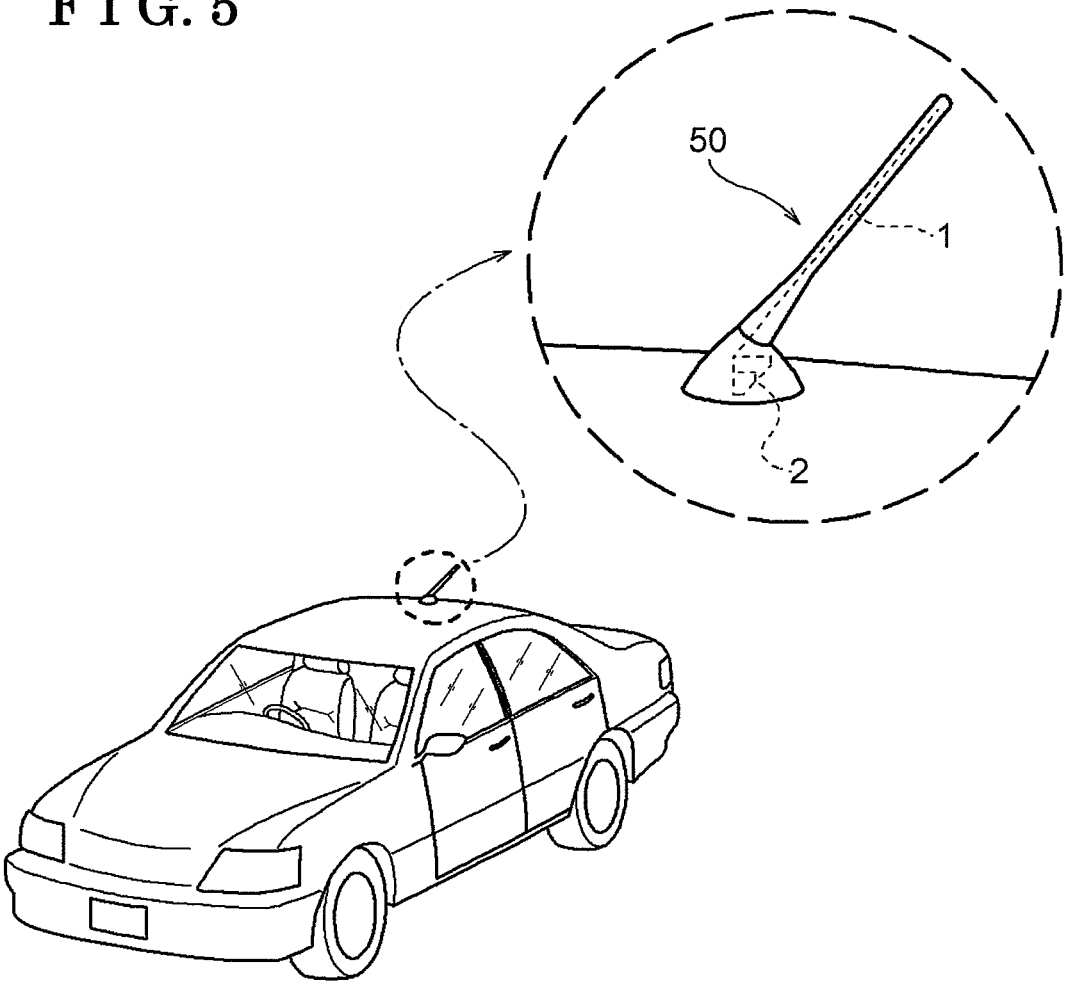
FIG. 5 is a perspective view showing an example that the multi-band monopole antenna according to the first embodiment is mounted to an automobile.

Structures of the multi-band monopole antenna 50 will be explained as follows. As shown in FIG. 5, the multi-band monopole antenna 50 is housed (sealed) inside a resin-made case together with injection resin and, for example, mounted to a body of an automobile. In those circumstances, the first radiation conductor portion 1 and the second radiation conductor portion 2 are integrally formed by punching a conductor thin plate. The conductor thin plate may be machined, for example, by punching an iron plate with thickness equal to or less than 1 mm. According to the foregoing manufacturing method, the first radiation conductor portion 1 and the second radiation conductor portion 2 can be machined with high precision. On the other hand, because the thickness of the conductor thin plate is equal to or less than 1 mm, bending strength (flexural strength) is assumed to be relatively low. Thus, as shown in FIG. 5, the first radiation conductor portion 1 and the second radiation conductor portion 2 formed by punching are sealed, for example, in the resin-made case together with injection resin which is injected onto the first radiation conductor portion 1 and the second radiation conductor portion 2 so that the bending strength is enhanced.

Further, as shown in FIG. 5, the multi-band monopole antenna 50 is mounted to the vehicle body. In those circumstances, the vehicle body serves as a ground conductor for the multi-band monopole antenna 50. Thus, a ground wire of the multi-band monopole antenna 50 may be connected to the body. As shown in FIG. 5, for example, the first radiation conductor portion 1 may be tilted relative to the vertical direction to be connected to the second radiation conductor portion 2.

According to the multi-band monopole antenna 50, the first radiation conductor portion 1 sends and receives the signal at one of the plural frequency bands, and the second radiation conductor portion 2 sends and receives the signal at another of the plural frequency bands. Further, because there is no need to provide ground conductor which serves as a pair with each of the first radiation conductor portion 1 and the second radiation conductor portion 2, the multiband monopole antenna 50 can be formed (manufactured) to be compact size. Further, according to the construction of the embodiment, by removing a part of the second radiation conductor portion 2, a reactance component of the second radiation conductor portion 2 can be adjusted. Thus, the impedance matching can be readily performed. According to the foregoing construction, because an impedance converter (impedance converting portion) is not required, the multi-band monopole antenna 50 can be produced (manufactured) at a lower cost.

According to the embodiment, as explained above, the first radiation conductor portion 1 and the second radiation conductor portion 2 are integrally formed by punching the conductor thin plate. However, the construction of the multi-band monopole antenna disclosed here is not limited to the foregoing construction. For example, the first radiation conductor portion 1 and the second radiation conductor portion 2 may be printed on a printed circuit board as a conductor layer. Because an inductance component increases by printing the first radiation conductor portion 1 and the second radiation conductor portion 2 on the printed circuit board, each of the electrical lengths L1, L2, L3 can be shortened. Thus, the multi-hand monopole antenna 50 can be formed (manufactured) to be compact size.

According to the embodiment, as explained above, the lowest frequency band among the plural frequency bands is defined as the first frequency band. However, the construction of the multi-band monopole antenna disclosed here is not limited to the foregoing construction. Frequency bands other than the lowest frequency band can be defined as the first frequency band. Even in those circumstances, by setting the first radiation conductor portion 1 to have the electrical length in accordance with the wavelength of the frequency of the subjected frequency band, the first radiation conductor portion 1 and the second radiation conductor portion 2 can construct the multi-band monopole antenna 50 together.

According to the embodiment, the opening portion 25, which is arranged, or formed to cross the line connecting the feed point 22 and the farthest point 24 which is arranged at the farthest position from the feed point 22 in the second radiation conductor portion 2. However, the construction of the multi-band monopole antenna disclosed here is not limited to the foregoing construction. For example, the second radiation conductor portion 2 may be constructed without the opening portion 25. Even in those circumstances, the first radiation conductor portion 1 and the second radiation conductor portion 2 can send and receive the signal from the plural frequency bands.

According to the construction of the embodiment, as explained above, the second radiation conductor portion 2 is formed in a pentagonal (five-sided) shape in cross section. However, the construction of the multi-band monopole antenna disclosed here is not limited to the foregoing construction. The second radiation conductor portion 2 may be formed in a configuration other than the pentagonal (five-sided) shape in the cross section.

According to the construction of the embodiment, as explained above, the cut oblique side 23 corresponds to an oblique side of the pentagonal (five-sided) shape in cross section. However, the construction of the multi-band monopole antenna disclosed here is not limited to the foregoing construction. For example, alternatively, the cut oblique side may be formed by removing another corner of the conductor planar other than the corner which is opposite to the connecting portion 21. Even in those circumstances, the reactance component of the second radiation conductor portion 2 is adjustable.

According to the embodiment, the connecting portion 21 is provided at the corner portion 30 which is positioned opposite to the cut oblique side 23. However, the construction of the multi-band monopole antenna disclosed here is not limited to the foregoing construction. For example, the connecting portion 21 may be provided at one of a sides 43 and the side 44 which are arranged having the corner portion 30 being opposite to the cut oblique side 23 therebetween, for example, at the side 43, and the feed point 22 may be provided at the side 41 which is positioned between the cut oblique side 23 and the other of the sides 43, 44, for example, the side 44. Alternatively, the connecting portion 21 may be provided at the other of the sides 43, 44 which are arranged having the corner portion 30 being opposite to the cut oblique side 23 therebetween, for example, at the side 44, and the feed point 22 may be provided at the side 42 which is positioned between the cut oblique side 23 and the side 43. Further, alternatively, the connecting portion 21 may be provided at one of the sides 43, 44 which are arranged having the corner portion 30 being opposite to the cut oblique side 23 therebetween, for example, at the side 43, and the feed point 22 may be provided at the side 42 which is positioned between the cut oblique side 23 and the side 43.

According to the embodiment, the feed point 22 is provided at the outer rim portion of the pentagonal (five-sided) shape in the cross-section. However, the construction of the multi-band monopole antenna disclosed here is not limited to the foregoing construction. For example, the feed point 22 may be provided at a position other than the outer rim portion of the pentagonal shape in the cross-section. Alternatively, the second radiation conductor portion 2 may be formed in a polygon in cross section other than the pentagonal cross section.

According to the embodiment, plural frequency bands correspond to 720 MHz band, 2.45 GHz band, and 5.8 GHz band. However, the construction of the multi-band monopole antenna disclosed here is not limited to the foregoing construction. Other frequency bands may be applied as the plural frequency bands.

According to the embodiment, the electrical length of each of the antenna elements is set at a centered frequency at each of the frequency bands. However, the construction of the multi-band monopole antenna disclosed here is not limited to the foregoing construction. The electrical length may be set in accordance with the frequency offset from the centered frequency of each of the frequency bands.

Figure 6:
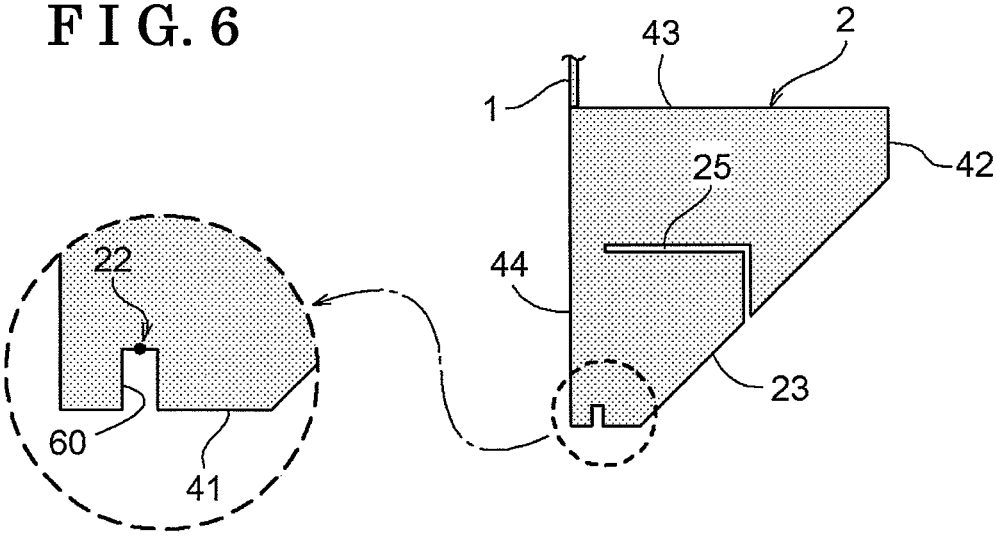
FIG. 6 is a schematic view of a multi-band monopole antenna according to a second embodiment disclosed here.

According to the embodiment, the feed point 22 is formed to be adjacent to the outer rim portion of the pentagonal (five sided) shape in the cross-section, that is, to be adjacent to the side 41. However, the construction of the multi-band monopole antenna disclosed here is not limited to the foregoing construction. For example, as shown in FIG. 6, the second radiation conductor portion 2 may include a recessed portion 60 which is formed by removing a portion of the second radiation conductor portion 2. In those circumstances, the feed point 22 may be provided at a rim portion of the recessed portion 60. Thus, the electrical length of the first radiation conductor portion 1 and the second radiation conductor portion 2 may be changed by the recessed portion 60, and the reactance component of the second radiation conductor portion 2 is assumed to be adjustable. Accordingly, the impedance matching can be appropriately performed.

Figure 7:
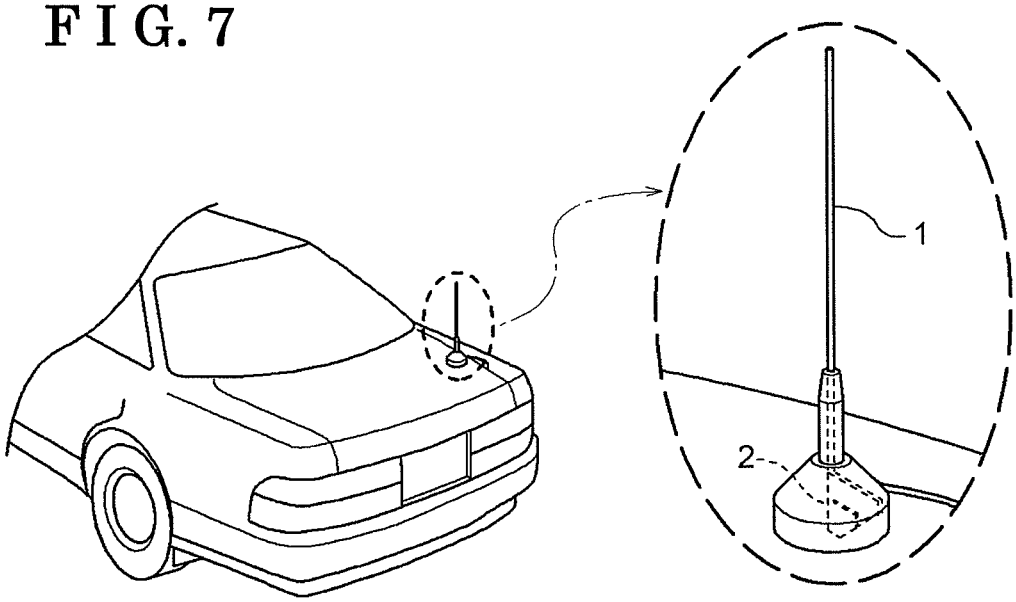
FIG. 7 is a perspective view of a multi-band monopole antenna according to a third embodiment disclosed here.

According to the embodiment, the first radiation conductor portion 1 and the second radiation conductor portion 2 of the multi-band monopole antenna 50 are formed by punching and are housed, or sealed within the resin case together with the injection resin. However, the construction of the multi-band monopole antenna disclosed here is not limited to the foregoing construction. For example, as shown in FIG. 7, the first radiation conductor portion 1 may be formed with a rod made of stainless steel, and by adjoining the stainless rod to a base portion in which the second radiation conductor portion 2 is housed.

According to the embodiment, the opening portion 25 includes the extending portion 25*a* and the perpendicular portion 25*b*. However, the construction of the multi-band monopole antenna disclosed here is not limited to the foregoing construction. The opening portion 25 may be structured without perpendicular portion 25*b* as long as the extending portion 25*a* crosses the line which connects the feed point 22 and the farthest point 24. Alternatively, the opening portion 25 may be formed in an arc shape. Further, alternatively, the opening portion 25 may be formed by the combination of a linear portion and an arc portion. Still further, alternatively, the opening portion 25 may not be adjacent to the outer rim portion of the second radiation conductor portion 2. In either configuration, the electrical length according to the wavelength of the frequency included in the frequency band which is different from the first frequency band and the second frequency band can be formed.

Figure 8A:
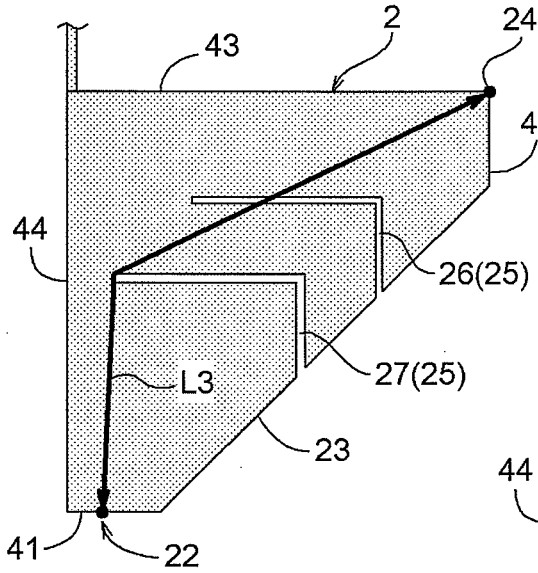
FIG. 8 is a schematic view of a multi-band monopole antenna according to a fourth embodiment disclosed here.
Figure 8B:
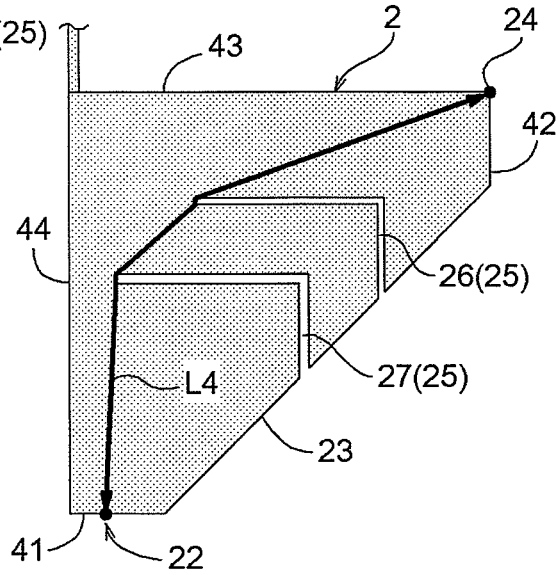

According to the embodiment, the single opening portion 25 is provided at the second radiation conductor portion 2. However, the construction of the multi-band monopole antenna disclosed here is not limited to the foregoing construction. For example, multiple numbers of the opening portions 25 may be provided at the second radiation conductor portion 2. As shown in FIGS. 8A and 8B, for example, the second radiation conductor portion 2 includes opening portions 26, 27. The opening portions 26, 27 may be formed to have either the same width or different widths from each other. For example, as shown in FIG. 8, widths of the opening portions 26, 27 differ from each other. In the example shown in FIG. 8, the width of the opening portion 26 is wider than the width of the opening portion 27. In those circumstances, a frequency band which crosses, or propagates across (over) the opening portions 26, 27 (i.e., corresponding to the second frequency band of the embodiment), a frequency band which crosses, or propagates across (over) one of the opening portions, the opening portion 26, as shown in FIG. 8A (i.e., corresponding to the third frequency band), and a frequency band which does not cross, or propagate across (over) either one of the opening portion 26 or 27 (e.g., a fourth frequency band corresponding to electrical length L4) may be set at the second radiation conductor portion 2. By providing the number of the opening portions equal to or greater than three to define electrical lengths, the multi-band monopole antenna can be applied further number of frequency bands.

According to the embodiment, the multi-band monopole antenna can send and receive the signal at plural frequency bands.

According to the embodiment, the multi-band monopole antenna includes the first radiation conductor portion (1) formed with the rod member having a length defined in accordance with the wavelength of the first frequency (f1) included in the predetermined first frequency band among plural frequency bands, and the second radiation conductor portion (2) integrally connected with the first radiation conductor portion (1) and formed with the planar member in which a direct distance from the feeding portion (22) to the farthest point (24) which is the farthest position from the feeding portion (22) is defined in accordance with a wavelength of a second frequency (f2) included in a second frequency band which differs from the first frequency band among the plural frequency bands. The feeding portion (22) is provided at a position based on the length defined in accordance with the wavelength of the first frequency relative to a position of a tip end of the first radiation conductor portion (1).

According to the construction of the embodiment, the first radiation conductor portion (1) can send and receive the signal at one of frequency band among the plural frequency bands, and the second radiation conductor portion (2) can send and receive the signal at another frequency band. Further, because there is no need to provide a grounding conductor portion, which serves as a pair with each of the first radiation conductor portion (1) and the second radiation conductor portion (2), the multi-band monopole antenna can be formed (manufactured) to be compact size. Further, because the reactance component of the second radiation conductor portion is adjustable in accordance with, or by changing the configuration of the second radiation conductor portion, the impedance matching is readily performed. Thus, because an impedance converting portion, or an impedance converter is not required, the multi-band monopole antenna can be produced, or manufactured at a lower manufacturing cost.

According to the embodiment, the feeding portion (22) is provided at the second radiation conductor portion (2).

According to the construction of the embodiment, the electrical length in accordance with the wavelength of the second frequency can be set, or defined only with the second radiation conductor portion.

According to the embodiment, a portion of an outer rim portion of the planar member of the second radiation conductor portion (2) ranging from the feeding portion (22) to the farthest point (24) is removed.

According to the construction of the embodiment, the reactance component of the second radiation conductor portion is adjustable by removing a part of the second radiation conductor (2). Thus, the impedance matching is readily performed. According to the foregoing construction, because the impedance converting portion or the impedance converter is not required, the multi-band monopole antenna can be produced or manufactured at a lower manufacturing cost.

According to the embodiment, the first frequency band corresponds to the lowest frequency band among the plural frequency bands.

According to the construction of the embodiment, because the dimension of the second radiation conductor (2) can be reduced, the multi-band monopole antenna can be produced, or manufactured to be compact size.

According to the embodiment, the second radiation conductor portion (2) includes an opening portion (25; 26, 27) which is arranged crossing a line connecting the feeding portion (22) and the farthest point (24).

According to the construction of the embodiment, an antenna element in which a length of the line directly connecting the feeding portion (22) and the farthest point (24) as an electrical length and an antenna element in which a length of the line connecting the feeding portion (22) and the farthest point (24) via an end portion of the opening portion (25) as an electrical length are formed on the second radiation conductor portion (2). Accordingly, the signals at the plural frequency bands can be sent and received at the second radiation conductor portion (2).

According to the construction of the embodiment, the opening portion (25) is a slit According to the construction of the embodiment, when forming the second radiation conductor portion (2) by punching, for example, pressing, the opening portion (25) can be formed simultaneously with forming the second radiation conductor portion. Thus, the manufacturing cost can be reduced.

According to the construction of the embodiment, the opening portion (25; 26, 27) includes a plurality of slits (26, 27).

According to the construction of the embodiment, the plurality of slits each includes different widths from one another.

According to the embodiment, the second radiation conductor portion (2) is structured with the planar member including a pentagonal shape in cross section which is formed by removing a right angle triangle including one of corner portions of a rectangular cross sectional shape, and an outer rim portion exposed by removing the right triangle corresponds to an oblique side (23).

According to the construction of the embodiment, for example, the second radiation conductor portion (2) can be formed by punching, for example, a thin iron plate. Thus, the second radiation conductor portion (2) which enables the impedance matching can be readily formed.

According to the embodiment, a connecting portion (21) of the second radiation conductor portion (2) connected to the first radiation conductor portion (1) is provided at a corner portion (30) which is positioned opposite to the oblique side (23), and the feeding portion (22) is provided at one of sides which are adjacent to the oblique side (23).

According to the construction of the embodiment, the feeding portion (22) and the connecting portion (21) can be separately arranged. Thus, the electrical length of the first radiation conductor portion can be structured including the length from the feeding portion (22) to the connecting portion (21). Accordingly, the multi-band antenna can be formed to be compact size.

According to the embodiment, a connecting portion (21) of the second radiation conductor portion (2) connected to the first radiation conductor portion (1) is provided at one of sides which are arranged adjacent to a corner portion (30) which is positioned opposite to the oblique side (23), and the feeding portion (22) is provided at a side which is arranged between the oblique side (23) and the other of the sides which are arranged adjacent to the corner portion (30).

According to the embodiment, even with the foregoing construction, the feeding portion (22) and the connecting portion (21) can be separately arranged. Thus, the electrical length of the first radiation conductor portion can be structured including the length from the feeding portion (22) to the connecting portion (21).

According to the embodiment, the second radiation conductor portion (2) includes a recessed portion (60) which is formed by removing a portion of the second radiation conductor portion (2), and the feeding portion (22) is provided at a rim portion of the recessed portion (60).

According to the construction of the embodiment, because the reactance component of the second radiation conductor portion can be changed, the impedance matching can be readily performed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A multi-band monopole antenna, comprising:

a first radiation conductor portion formed with a rod member having a length defined in accordance with a wavelength of a first frequency included in a predetermined first frequency band among plural frequency bands;

a second radiation conductor portion integrally connected with the first radiation conductor portion and formed with a planar member in which a shortest direct distance from a feeding portion to a farthest point which is the farthest position from the feeding portion is defined in accordance with a wavelength of a second frequency included in a second frequency band which differs from the first frequency band among the plural frequency bands; and wherein the feeding portion is provided at a position based on the length defined in accordance with the wavelength of the first frequency relative to a position of a tip end of the first radiation conductor portion;

wherein the feeding portion is provided at the second radiation conductor portion;

wherein a portion of an outer rim portion of the planar member of the second radiation conductor portion ranging from the feeding portion to the farthest point is removed, wherein the second radiation conductor portion is structured with the planar member including a pentagonal shape in cross section which is formed by removing a right angle triangle including one of corner portions of a rectangular cross sectional shape, and an outer rim portion exposed by removing the right triangle corresponds to an oblique side, wherein a connecting portion of the second radiation conductor portion connected to the first radiation conductor portion is provided at a corner portion which is positioned opposite to the oblique side, and the feeding portion is provided at one of sides which are adjacent to the oblique side;

the opening portion includes an extending portion and a perpendicular portion; the extending portion extends in the same direction as the first radiation conductor portion from the cut oblique side; the perpendicular portion is perpendicular to the extending the portion.

2. The multi-band monopole antenna according to claim 1, wherein the first frequency band corresponds to the lowest frequency band among the plural frequency bands.

3. The multi-band monopole antenna according to claim 1, wherein the second radiation conductor portion includes an opening portion which is arranged crossing a line connecting the feeding portion and the farthest point.

4. The multi-band monopole antenna according to claim 3, wherein the opening portion is a slit.

5. The multi-band monopole antenna according to claim 3, wherein the opening portion includes a plurality of slits.

6. The multi-band monopole antenna according to claim 5, wherein the plurality of slits each includes different widths from one another.

7. The multi-band monopole antenna according to claim 1, wherein the second radiation conductor portion includes a recessed portion which is formed by removing a portion of the second radiation conductor portion, and the feeding portion is provided at a rim portion of the recessed portion.

8. A multi-band monopole antenna, comprising:

a first radiation conductor portion formed with a rod member having a length defined in accordance with a wavelength of a first frequency included in a predetermined first frequency band among plural frequency bands;

a second radiation conductor portion integrally connected with the first radiation conductor portion and formed with a planar member in which a shortest direct distance from a feeding portion to a farthest point which is the farthest position from the feeding portion is defined in accordance with a wavelength of a second frequency included in a second frequency band which differs from the first frequency band among the plural frequency bands; and wherein the feeding portion is provided at a position based on the length defined in accordance with the wavelength of the first frequency relative to a position of a tip end of the first radiation conductor portion;

wherein the feeding portion is provided at the second radiation conductor portion;

wherein a portion of an outer rim portion of the planar member of the second radiation conductor portion ranging from the feeding portion to the farthest point is removed, wherein the second radiation conductor portion is structured with the planar member including a pentagonal shape in cross section which is formed by removing a right angle triangle including one of corner portions of a rectangular cross sectional shape, and an outer rim portion exposed by removing the right triangle corresponds to an oblique side, wherein a connecting portion of the second radiation conductor portion connected to the first radiation conductor portion is provided at one of sides which are arranged adjacent to a corner portion which is positioned opposite to the oblique side, and the feeding portion is provided at a side which is arranged between the oblique side and the other of the sides which are arranged adjacent to the corner portion;

the opening portion includes an extending portion and a perpendicular portion; the extending portion extends in the same direction as the first radiation conductor portion from the cut oblique side; the perpendicular portion is perpendicular to the extending the portion.

* * * * *